US011808113B2

(12) United States Patent
Al-Mousa

(10) Patent No.: US 11,808,113 B2
(45) Date of Patent: Nov. 7, 2023

(54) MUD SAVER AND METAL COLLECTOR BELL NIPPLE

(71) Applicant: Saudi Arabian Oil Company, Dhahran (SA)

(72) Inventor: Ahmed Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/648,082

(22) Filed: Jan. 14, 2022

(65) Prior Publication Data

US 2023/0228169 A1 Jul. 20, 2023

(51) Int. Cl.
*E21B 41/00* (2006.01)
*E21B 33/06* (2006.01)

(52) U.S. Cl.
CPC ..... *E21B 41/0021* (2013.01); *E21B 33/06* (2013.01)

(58) Field of Classification Search
CPC ..... E21B 41/0021; E21B 33/06
See application file for complete search history.

(56) References Cited

U.S. PATENT DOCUMENTS 3,187,238 A * 6/1965 Wilson ..... E21B 41/0021 335/289
3,409,084 A 11/1968 Lawson
3,885,629 A 5/1975 Erb et al.
4,203,472 A 5/1980 Dulaney
4,553,591 A * 11/1985 Mitchell ..... E21B 47/117 166/95.1
4,836,289 A 6/1989 Young
6,470,975 B1 10/2002 Bourgoyne et al.
7,921,917 B2 4/2011 Kotrla et al.
9,476,279 B2 10/2016 Bailey et al.
9,624,746 B2 4/2017 Hendel et al.
10,024,154 B2 7/2018 Gray et al.
10,400,552 B2 9/2019 Gilmore et al.
2008/0210471 A1 9/2008 Bailey et al.
(Continued)

FOREIGN PATENT DOCUMENTS

EP 3907188 A1 * 11/2021
WO WO 2011045943 4/2011
WO WO 2013013136 1/2013

OTHER PUBLICATIONS

U.S. Appl. No. 17/650,476, Al-Mousa, filed Feb. 9, 2022.
(Continued)

*Primary Examiner* — Blake Michener
*Assistant Examiner* — Yanick A Akaragwe
(74) *Attorney, Agent, or Firm* — Fish & Richardson P.C.

(57) ABSTRACT

A bell nipple assembly includes a tubular main body and a catcher assembly positioned above the tubular main body that includes an upper opening with a diameter greater than an inner diameter of the tubular main body and one or more inwardly sloping inner surfaces configured to catch fluids falling from the rig floor or from an exterior surface of the drill string and to direct the fluids to the tubular main body. The bell nipple assembly also includes one or more magnets configured to direct a magnetic field toward an interior of the catcher assembly and to attract a metallic object falling within the interior of the catcher assembly towards the inwardly sloping inner surfaces.

24 Claims, 6 Drawing Sheets

(56) References Cited

U.S. PATENT DOCUMENTS

| | | | | |
|---|---|---|---|---|
| 2013/0020096 | A1* | 1/2013 | DeRouen, Sr. | B03C 1/288 166/66.5 |
| 2020/0291767 | A1 | 9/2020 | Kroslid et al. | |

OTHER PUBLICATIONS

CCSC, "Bell nipple," CCSC Petroleum Equipment Co., Ltd, 2018, retrieved Mar. 21, 2022, retrieved from URL <ww.ccscpetro.com/bell_nipple_flange.html>, 1 page.
Cudd Energy Services, "Cudd Energy Services Brochure," 2016, 8 pages.
geodf.com [online], "Geo Drilling Fluids Manual: Drilling Practices to Reduce The Cost of PetroDrill Mud," Geo Drilling Fluids, Inc., available at URL <https://www.yumpu.com/en/document/read/21474235/petrodrill-brochure-geo-drilling-fluids-inc/6>, 1 page.
Katch Kan Limited Catalog, "Upper Katch Kan," 2007, 2 pages.
Katch Kan, "Upper Katch Kan," Katch Kan Brochure, Product Info Sheet, Nov. 2019, 1 page.
Ritchie et al., "Glossary of Petroleum Systems Reliability Analysis," Office of Research and Monitoring and Office of Water Program Operations U.S. Environmental Protection Agency, Aug. 1973, 2 pages.

* cited by examiner

MUD SAVER AND METAL COLLECTOR BELL NIPPLE

TECHNICAL FIELD

This disclosure relates to wellbore operations, for example, operations performed while drilling a wellbore.

BACKGROUND

This disclosure relates to wellbore operations, for example, operations performed while drilling a wellbore. Hydrocarbons or other resources in subsurface reservoirs or locations below the Earth's surface can be produced to the surface by forming wellbores from the surface to the subsurface locations. A wellbore is drilled from a surface rig to the subsurface reservoir by a wellbore drilling assembly. During drilling, a drilling mud or other fluid is flowed from the surface into the wellbore through a drill string and is flowed to the surface out of the wellbore through an annulus formed between an outer surface of the drill string and the wellbore. Drilling mud and other fluids can spill, leak, or flow from the drill string or other conduits or through a rig floor, rotary table, or other location on the rig. In addition, tools or other metallic objects can be accidently or inadvertently dropped or otherwise fall from the rig floor or other locations.

SUMMARY

Certain aspects of the subject matter herein can be implemented as a bell nipple assembly configured to be positioned above a blow-out preventer stack and below a rig floor of a well drilling system. The bell nipple assembly includes a tubular main body fluidically connected to an inner bore of the blow-out preventer stack. The inner bore is configured to receive a drill string. The bell nipple assembly further includes a catcher assembly positioned above the tubular main body that includes an upper opening with a diameter greater than an inner diameter of the tubular main body and one or more inwardly sloping inner surfaces configured to catch fluids falling from the rig floor or from an exterior surface of the drill string and to direct the fluids to the tubular main body. The bell nipple assembly also includes one or more magnets configured to direct a magnetic field toward an interior of the catcher assembly and to attract a metallic object falling within the interior of the catcher assembly towards the one or more inwardly sloping inner surfaces.

An aspect combinable with any of the other aspects can include the following features. At least a portion of the one or more magnets can be within or can comprise a sloping wall of the catcher assembly.

An aspect combinable with any of the other aspects can include the following features. At least a portion of the one or more magnets can include one or more magnets positioned on an exterior surface of the catcher assembly and configured to direct a magnetic field through a wall of the catcher assembly.

An aspect combinable with any of the other aspects can include the following features. At least one of the one or more inwardly sloping inner surfaces can be frustoconical.

An aspect combinable with any of the other aspects can include the following features. The catcher assembly can include a plurality of nested frustal segments. Each of the plurality of nested frustal segments can form a respective inwardly sloping inner surface.

An aspect combinable with any of the other aspects can include the following features. The respective inwardly sloping inner surfaces can be bounded by horizontal annular discs.

An aspect combinable with any of the other aspects can include the following features. At least one of the one or more inwardly sloping inner surfaces can be frustospherical.

An aspect combinable with any of the other aspects can include the following features. At least one of the one or more inwardly sloping inner surfaces can be frustoparabolic.

An aspect combinable with any of the other aspects can include the following features. The rig floor can include a rotary table and the diameter of the upper opening can be greater than the diameter of the rotary table.

An aspect combinable with any of the other aspects can include the following features. The blow-out preventer stack can include a plurality of preventers.

An aspect combinable with any of the other aspects can include the following features. The bell nipple assembly can further include a flowline configured to flow fluid from the tubular main body.

An aspect combinable with any of the other aspects can include the following features. The catcher assembly can be removable from the tubular main body.

Certain aspects of the subject matter herein can be implemented as a drilling system for drilling a wellbore into a subterranean zone. The drilling system can include a drill string suspended from a drilling rig and a blow-out preventer stack through which the drill string passes as the drill string is raised or lowered within the wellbore. The drilling system can also include a bell nipple assembly configured to be positioned above the blow-out preventer stack and below a rig floor of the drilling rig. The bell nipple assembly can also include a tubular main body fluidically connected to an inner bore of the blow-out preventer stack. The inner bore can be configured to receive the drill string. A catcher assembly can be positioned above the tubular main body and can include an upper opening with a diameter greater than an inner diameter of the tubular main body and one or more inwardly sloping inner surfaces configured to catch fluids falling from the rig floor or from an exterior surface of the drill string and to direct the fluids to the tubular main body. The bell nipple assembly can further include one or more magnets configured to direct a magnetic field toward an interior of the catcher and to attract a metallic object falling within the interior of the catcher assembly towards the one or more inwardly sloping inner surfaces.

An aspect combinable with any of the other aspects can include the following features. At least a portion of the one or more magnets can be within or can comprise a sloping wall of the catcher assembly.

An aspect combinable with any of the other aspects can include the following features. At least a portion of the one or more magnets can include one or more magnets positioned on an exterior surface of the catcher assembly and configured to direct a magnetic field through a wall of the catcher.

An aspect combinable with any of the other aspects can include the following features. At least one of the one or more inwardly sloping inner surfaces can be frustoconical.

An aspect combinable with any of the other aspects can include the following features. The catcher assembly can include a plurality of nested frustal segments. Each of the plurality of nested frustal segments can form a respective inwardly sloping inner surface An aspect combinable with any of the other aspects can include the following features. The respective inwardly sloping inner surfaces can be bounded by horizontal annular discs.

An aspect combinable with any of the other aspects can include the following features. At least one of the one or more inwardly sloping inner surfaces can be frustospherical.

An aspect combinable with any of the other aspects can include the following features. At least one of the one or more inwardly sloping inner surfaces can be frustoparabolic.

An aspect combinable with any of the other aspects can include the following features. The rig floor includes a rotary table and the diameter of the upper opening can be greater than the diameter of the rotary table.

An aspect combinable with any of the other aspects can include the following features. The blow-out preventer stack can include a plurality of preventers.

An aspect combinable with any of the other aspects can include the following features. The catcher assembly can be removable from the tubular main body.

Certain aspects of the subject matter herein can be implemented as a method of drilling, with a drill string suspended from a drilling rig, a wellbore into a subterranean zone. The method includes providing, as a component of the drilling rig, a blow-out preventer stack through which the drill string passes as the drill string is raised or lowered within the wellbore. A bell nipple assembly is attached to an upper end of the blow-out preventer stack and positioned below a rig floor of the drilling rig. The bell nipple assembly includes a tubular main body fluidically connected to an inner bore of the blow-out preventer stack. The inner bore is configured to receive the drill string. The bell nipple assembly further includes a catcher assembly positioned above the tubular main body. The catcher assembly includes an upper opening with a diameter greater than an inner diameter of the tubular main body, one or more inwardly sloping inner surfaces, and one or more magnets configured to direct a magnetic field toward an interior of the catcher assembly. The method further includes drilling the wellbore with the drill string, catching, during the drilling and by the catcher assembly, fluids falling from the rig floor or from an exterior surface of the drill string, and directing, by the catcher assembly, the fluids to the tubular main body. The method further includes attracting, by the one or more magnets, a magnetic object falling within the interior of the catcher assembly towards the one or more inwardly sloping inner surfaces.

The details of one or more embodiments are set forth in the accompanying drawings and the description below. Other features, objects, and advantages will be apparent from the description and drawings, and from the claims.

DETAILED DESCRIPTION

The details of one or more implementations of the subject matter of this specification are set forth in this detailed description, the accompanying drawings, and the claims. Other features, aspects, and advantages of the subject matter will become apparent from this detailed description, the claims, and the accompanying drawings.

During drilling operations, drilling fluid or other fluids can collect around an exterior surface of a drill string as it is raised or lowered into a wellbore. Fluids can also flow from leaks or other sources in, around, or above a rig floor and can tend to flow downwards and/or fall through or around the edges or openings of, on, in, or around the rig floor. The collection of such fluids can create a hazardous condition (for example, fire or slipping hazard). Furthermore, such fluid loss can negatively impact rig operations and reduce rig efficiency.

Furthermore, it is common for metallic tools (such as wrenches or other hand-held tools) or other metal objects to accidently or inadvertently be dropped or otherwise fall from the rig floor. If such objects fall into, for example, a blow-out preventer stack or other rig equipment, the can potentially interfere with the operation of such equipment and/or create other hazardous or undesirable conditions. Such fallen objects can be difficult or impossible to retrieve, and the loss hand tools or other such metallic objects can have an economic impact or otherwise impact the operations or efficiency of the well drilling system.

In accordance with some embodiments of the present disclosure, a catcher assembly that is a component of a bell nipple assembly of a well system can more effectively capture drilling mud or other fluids and also metallic objects that may flow or fall from exterior surfaces of a drill string or from other sources or locations in, around, or above a rig floor. In addition, the catcher assembly can attract and capture metal objects that may fall from the rig floor or other locations, and enable easier or more efficient retrieval of such objects.

Figure 1:
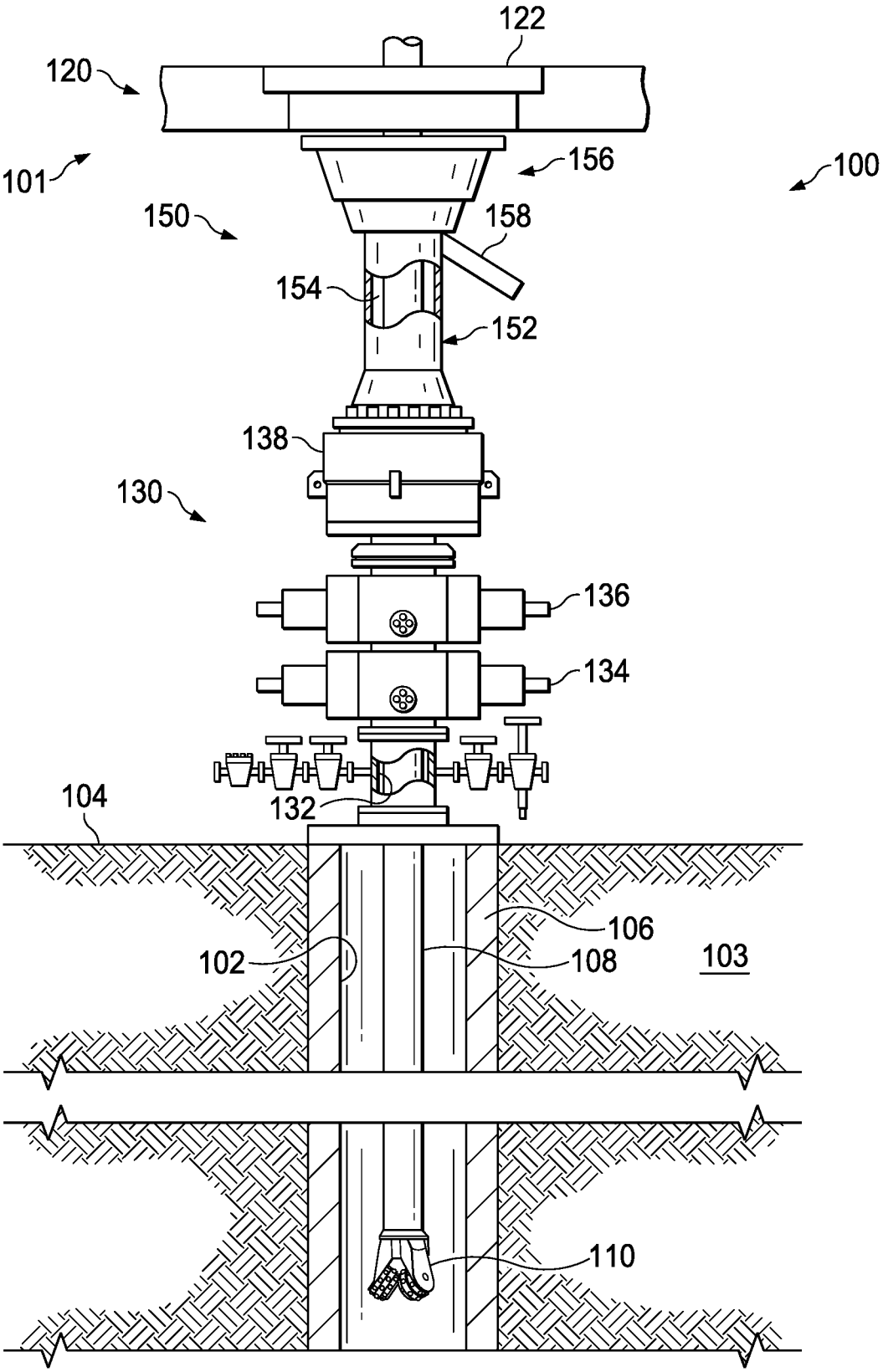
FIG. 1 is a schematic illustrations of a well system in accordance with an embodiment of the present disclosure.

FIG. 1 is an example of well system 100 in accordance with an embodiment of the present disclosure. As depicted, well system 100 includes a wellhead portion of a workover or drilling rig 101 that is positioned on or above the earth's surface 104 (for example, a terranean surface or a sub-sea surface) and extends over and around a wellbore 102 that penetrates a subterranean zone 103 for the purpose of extracting hydrocarbons or other substances or for conducting other subsurface operations (such as fluid injection or geothermal heat recovery). The wellbore 102 may be drilled into the subterranean formation using any suitable drilling technique.

The illustrated wellbore 102 extends substantially vertically (that is, vertical as designed) away from the earth's surface 104. In alternative operating environments, all or portions of the wellbore 102 may be vertical, deviated at any suitable angle, horizontal, curved or both. The wellbore 102 may be a new wellbore, an existing wellbore, a straight wellbore, an extended reach wellbore, sidetracked wellbore, a multi-lateral wellbore, and other types of wellbores for drilling and completing one or more production zones. Casing 106 installed in wellbore 102 ensures integrity of the borehole and isolate subterranean zone 103 adjacent to wellbore 102. Cement can fill the annulus between the casing 106 and wellbore 102. A drill string 108 or other wellbore tubular (such as a workover string or production string) can be lowered into the subterranean formation for a variety of purposes (for example, drilling, intervening, injecting or producing fluids from the wellbore, workover or treatment procedures, or otherwise) throughout the life of wellbore 102. In this illustrated example, the workover or drilling rig comprises a derrick with the rig floor 120 through which the drill string 108 extends downward from the drilling rig into the wellbore 102. In the illustrated embodiment, well system 100 includes a rotary table 122 that is a revolving or spinning section of the drill floor that provides power to turn drill string 108 in, for example, a clockwise direction (as viewed from above). The rotary motion and power can be transmitted through a kelly bushing and kelly (not shown) to drill string 108. In some embodiments, well system 100 can in a top-drive or other rig type that may not include a rotary table.

Drill string 108 can comprise tubular pipe segments connected with tool joints and can include a drill bit 110 at its downhole end. The may comprise a motor driven winch and other associated equipment for extending the drill string 116 into the wellbore 102 to position the drill string at a selected depth. While the operating environment depicted in FIG. 1 refers to a drilling rig 101 for conveying the drill string 108 within a land-based wellbore 102, embodiments of the present invention can be used for drilling, workover, or completion rigs in onshore or offshore settings. For example, in some embodiments, workover rigs, wellbore servicing units (such as coiled tubing units), and the like may be used to lower a drill string or other wellbore tubular into the wellbore 102, in an on-shore or offshore setting.

As illustrated, drill string 108 extends through blowout preventer (BOP) stack 130, which can stop or reduce a flow of fluids from wellbore 102 in the event of a pressure kick, blowout, or other well control event or emergency. In the illustrated embodiment, BOP stack 130 has a central bore 132 in which an upper portion of drill string 108 is disposed. In the illustrated embodiment, BOP stack 130 includes two preventers 134 and 136, each of which can be, for example, a pipe ram preventer, a shear ram preventer, a blind ram preventer, or another suitable type of preventer. A pipe ram preventer can include, for example, a pair of horizontally opposed metal rams, each with a half-circle hole on the edge to mate with the other so as to form a hole, with the hole sized such that, when closed, the rams can fit around drill string 108, thereby closing BOP stack 130 and preventing further flow of fluids around drill string 108. A shear ram preventer can include, for example, a pair of rams with hardened tool steel blades designed to cut through a drill pipe segment. A blind ram preventer can include, for example, a pair of metal rams which can close to seal off the BOP stack if there is no drill string segment or other object within the stack (for example, if drill string 108 has been severed by a shear ram preventer). In some embodiments, BOP stack 130 can include additional or fewer preventers of one or more of the preceding types or other suitable types. In the illustrated embodiment, BOP stack 130 includes an annular preventer 138 which can include, for example, a rubber packing element which can close around drill string 108. BOP stack 130 can be configured to provide maximum pressure integrity, safety and flexibility in the event of a well control incident. BOP stack 130 can also include various other preventers, spools, adapters, valves, and piping outlets (not shown) to permit, prevent, or regulate the circulation of wellbore fluids under pressure during normal operations and/or in the event of a well control incident or other situation or emergency.

In the illustrated embodiment, well system 100 further includes a bell nipple assembly 150 (which can also be referred to as a "flow nipple"). In the illustrated embodiment, bell nipple assembly 150 is positioned above BOP stack 130 and below rig floor 120, and includes tubular main body 152 with central bore 154 fluidically connected to central bore 132 of BOP stack 130. Central bore 154 is configured to receive a drill string 108. In operation, a drilling fluid is flowed down a central bore of drill string 108 and exits drill bit 110. The drilling fluid then flows upwards in the annulus between drill string 108 and casing 106. The drilling fluid flows upwards through BOP stack 130 and into bell nipple assembly 150, and exits bell nipple assembly 150 via flowline 158 into a trip tank or other suitable container (not shown). A pump (not shown) can then return the drilling via return a Kelly hose or other suitable conveyance back to the central bore of drill string 108.

During such operations, drilling fluid or other fluids can collect around an exterior surface of drill string 108 as drill string 108 is raised or lowered into wellbore 102. Such fluids can also flow from leaks or other sources in, around, or above rig floor 120 and/or rotary table 122. Such fluids can tend to flow downwards and/or fall through or around the edges or openings of, on, in, or around rig floor 120 and/or rotary table 122. The collection of such fluids can create a hazardous condition (for example, fire or slipping hazard). Furthermore, to the extent drilling fluids exit bell nipple assembly 150 (for example, by splashing or leaking) and do not return to the system via flowline 158, such fluid loss can negatively impact rig operations and reduce rig efficiency.

Furthermore, it is common for metallic tools (such as wrenches or other hand-held tools) or other metal objects to fall from rig floor 120 and/or rotary table 122 and into the central bore 154 of bell nipple assembly 150. Such objects can pass through BOP stack 130 and can potentially interfere with the operation of the preventers of BOP stack 130 (for example, by interfering with movement or closure of their component parts) and/or create other hazardous or undesirable conditions as they fall through and collect within central bore 154 of main body 152 of bell nipple assembly 150, the central bore 132 of BOP stack 130, and/or the annulus between drill string 108 and casing 106. Even if such objects stop or are caught within main body 152 before entering BOP stack 130 or the wellbore 102 annulus, such objects can be difficult or impossible to retrieve, and the loss hand tools or other such metallic objects can have an economic impact or otherwise impact the operations or efficiency of well system 100, as the tools must be replaced and/or are no longer available to the personnel at the rig site.

In the illustrated embodiment, and as described in more detail in the following figures, bell nipple assembly 150 further includes a catcher assembly 156 that can capture such fluids flowing or falling from rig floor 120 and/or rotary table 122 and that can catch metallic objects which otherwise would fall into central bore 154 of bell nipple assembly 150, central bore 132 of BOP stack 130 and/or the annulus between drill string 108 and casing 106. In addition to reducing or eliminating the hazards and operational consequences of such lost fluids and objects, the design of catcher assembly 156 enables easier retrieval of such objects.

Figure 2A:
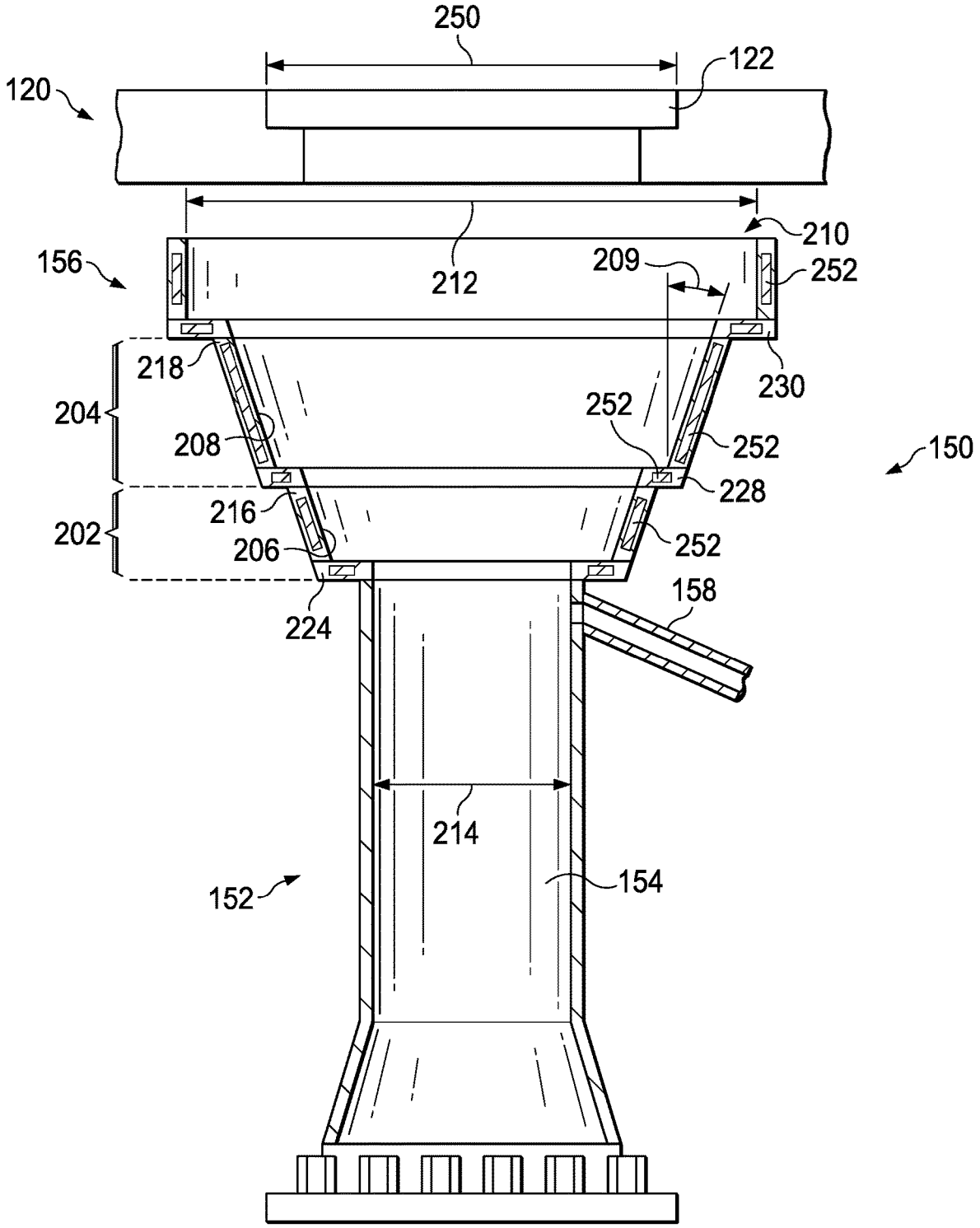
FIGS. 2A and 2B are schematic cross-sectional and perspective illustrations, respectively, of a bell nipple assembly in accordance with an embodiment of the present disclosure.
Figure 2B:
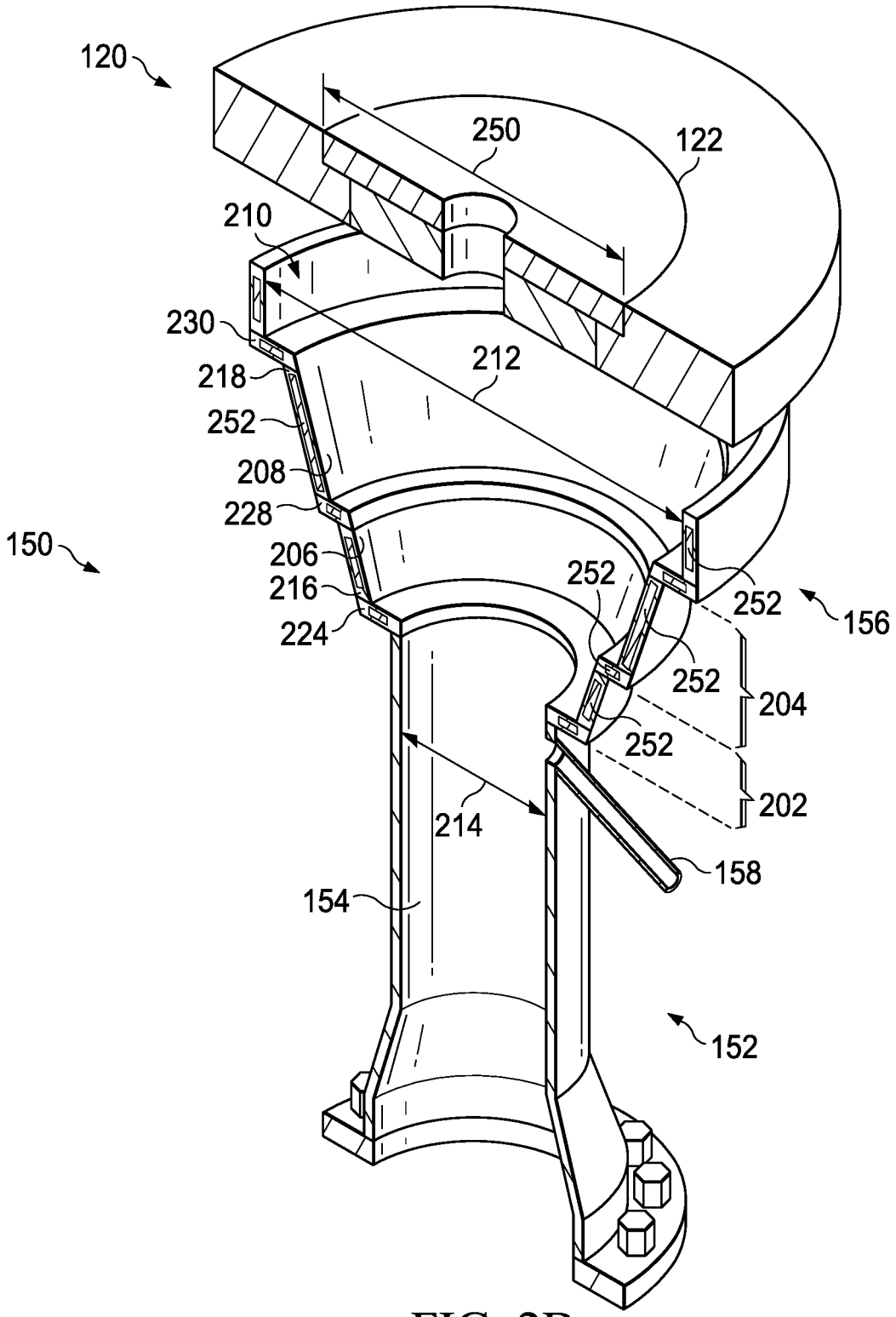

Referring to FIGS. 2A and 2B, catcher assembly 156 is positioned above tubular main body 152 of bell nipple assembly 150 and is fluidically connected to central bore 154. FIG. 2A is a cross-sectional view and FIG. 2B is a perspective view. Catcher assembly 156 includes an upper opening 210 with a diameter 212 that is greater than an inner diameter 214 of central bore 154. In the illustrated embodiment, catcher assembly 156 includes a plurality of frustal segments (that is, segments that are in the shape of an inverted frustum); specifically, catcher assembly 156 includes lower frustal segment 202 and upper frustal segment 204 which have different diameters and are nested to form inwardly sloping inner surfaces 206 and 208 configured to catch fluids falling from the rig floor 120, rotary table 122, and/or from an exterior surface of the drill string and to direct the fluids to the tubular main body 152. In the illustrated embodiment, frustum segments 202 and 204 and respective inner surfaces 206 and 208 are frusto-conical in shape (that is, each segment or surface forms or is in the shape of an inverted conical frustum). In some embodiments, instead of (or in addition to) frusto-conical segments forming nested frusto-conical sloping inner surfaces, some or all of the frustum segments and their respective inwardly sloping inner surfaces can be frustospherical (that is, forming or comprising a surface that is an inverted spherical frustum) or frustoparabolic (that is, forming or comprising a surface that is an inverted parabolic frustum). In some embodiments, the body of one or more of the segments is other than frustal but the inner surface formed by the body is frustal. In some embodiments, the diameter 212 of upper opening 210 is greater than the diameter 250 of rotary table 122. In some embodiments, the catcher assembly can have a fewer or greater number of frustal segments and/or sloping inner surfaces. In some embodiments, the sloping inner surfaces 206 and 208 are sloped at an angle 209 of approximately twenty degrees (20°) from vertical. In some embodiments, one or more of the sloping inner surfaces can be sloped at a greater or lesser angle from vertical.

Figure 3:
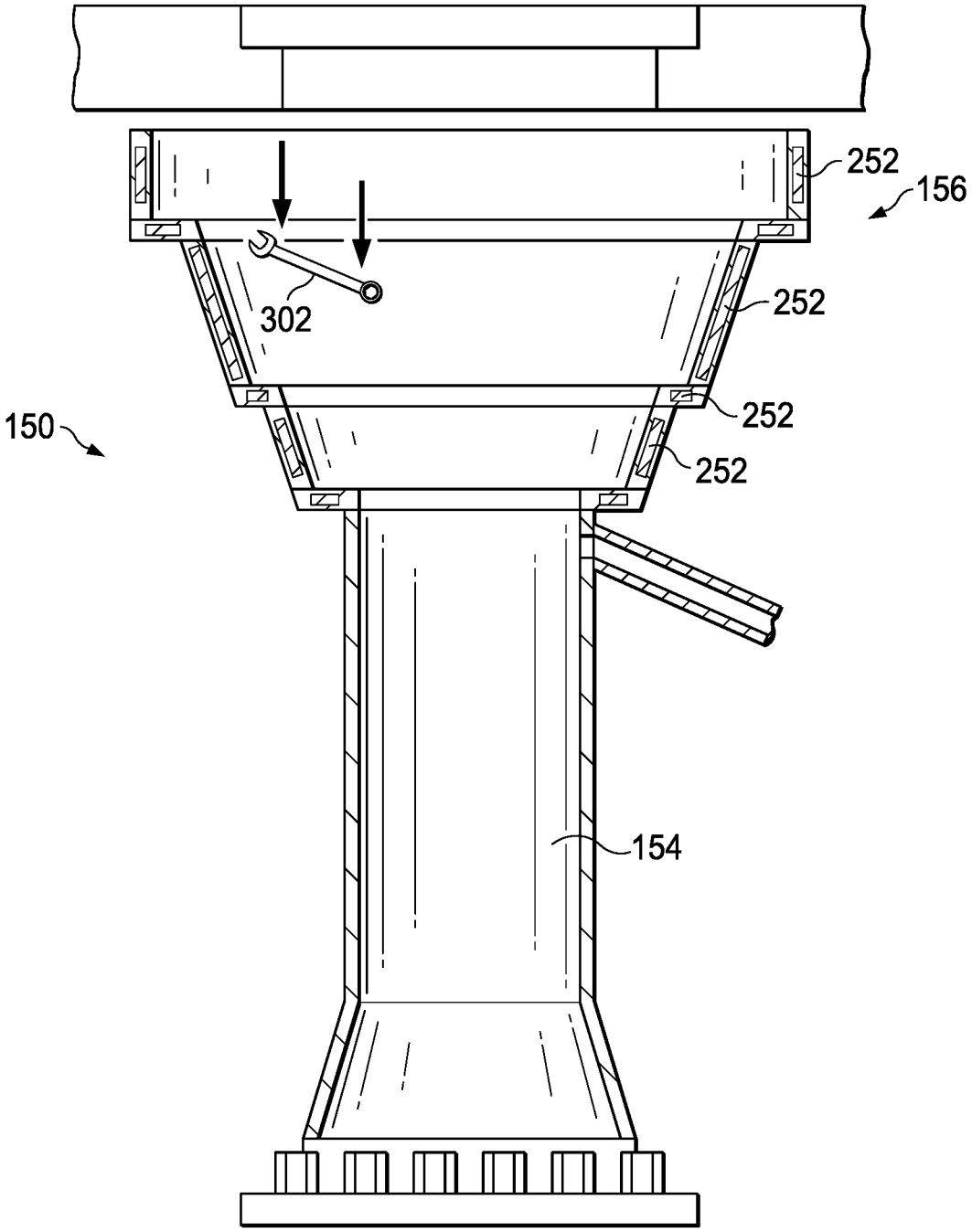
FIGS. 3 and 4 are a schematic illustrations of a metallic object falling into and being captured by a catcher assembly of the bell nipple assembly of FIGS. 2A and 2B in accordance with an embodiment of the present disclosure.
Figure 4:
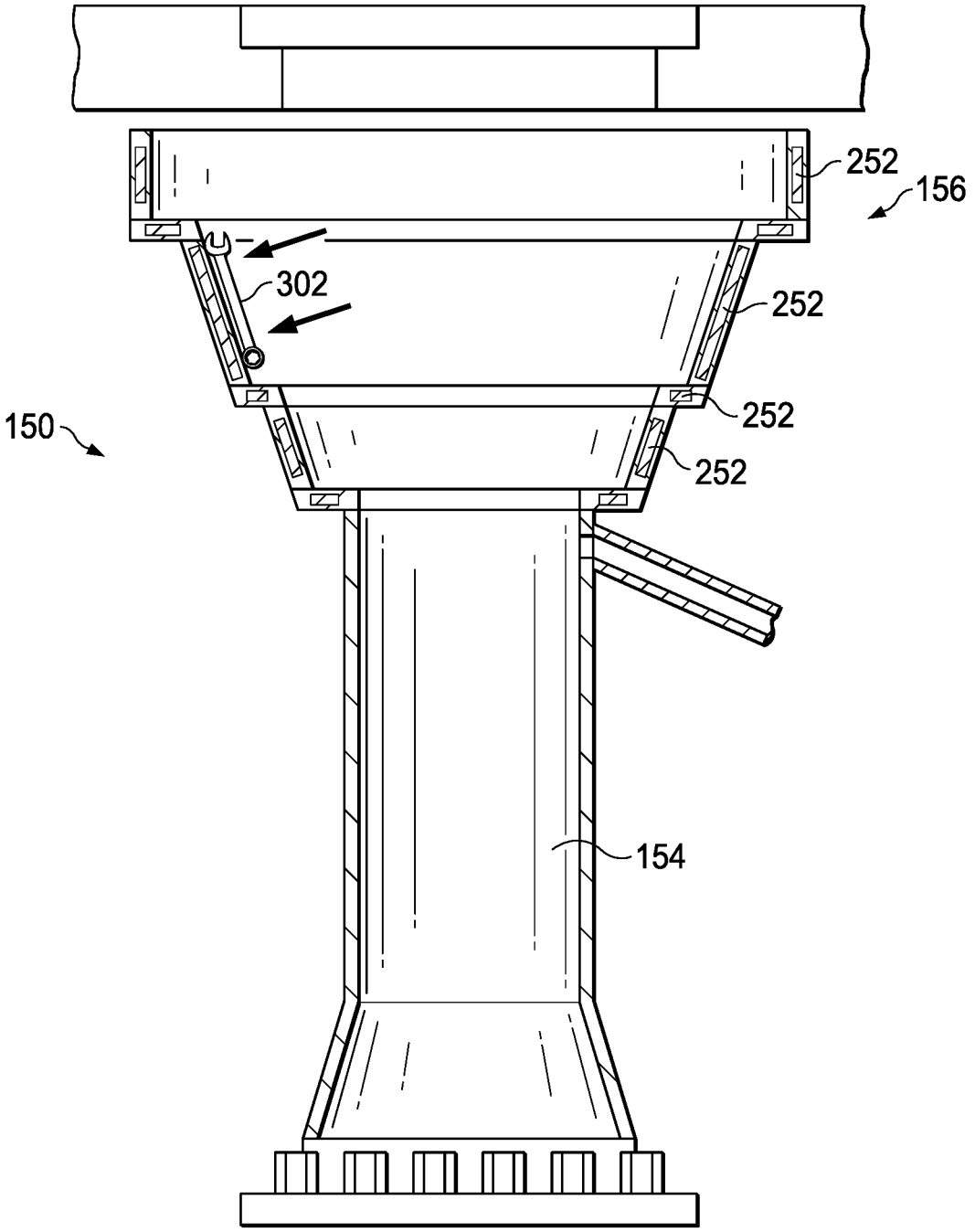
Figure 5:
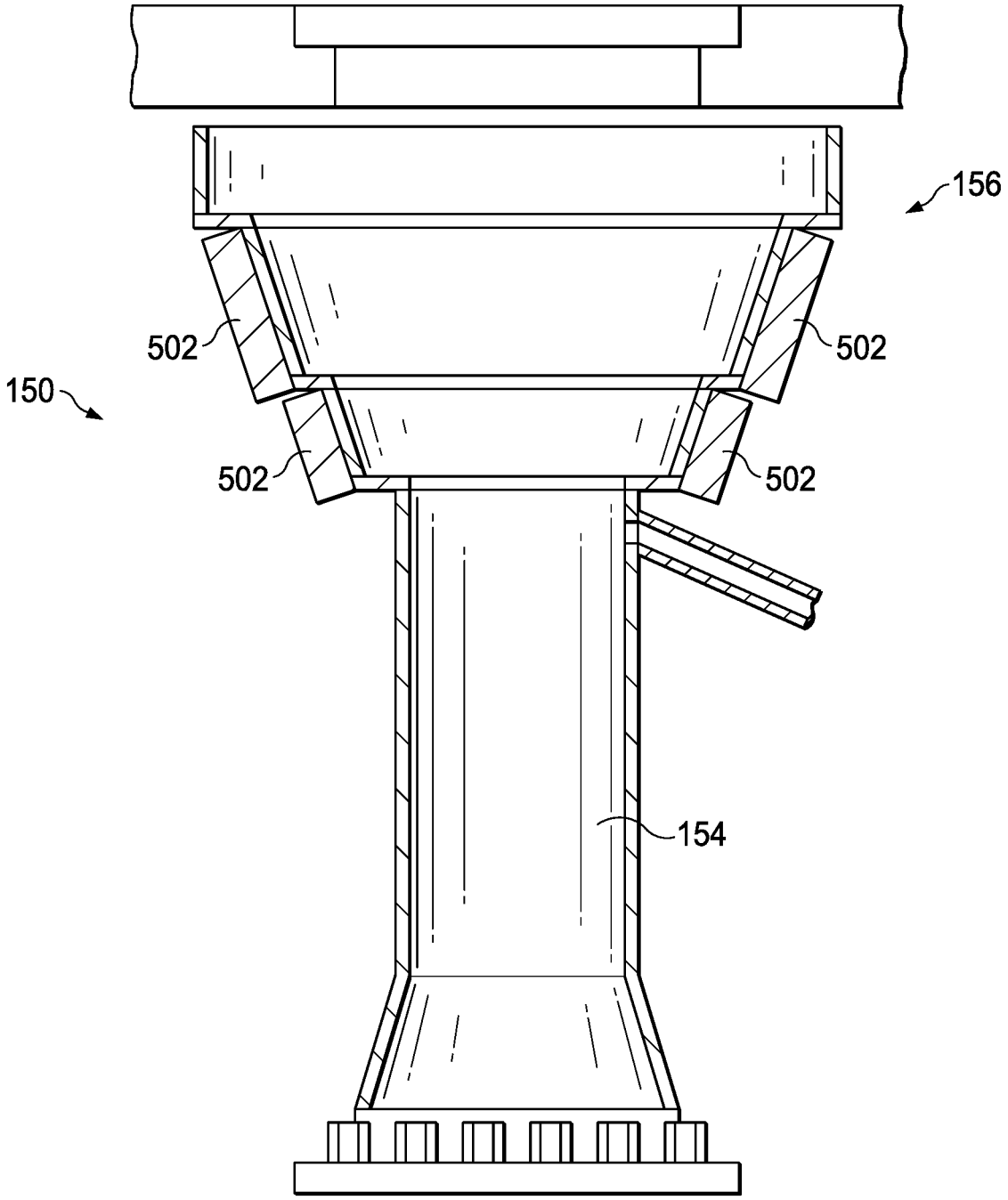
FIG. 5 is a schematic cross-sectional illustration of a bell nipple assembly in accordance with an alternative embodiment of the present disclosure.

Catcher assembly 156 further includes one or more magnets 252 configured to direct a magnetic field toward an interior of the catcher assembly. As shown in FIGS. 3 and 4, the magnetic field can cause a dropped wrench or lost tool or other metallic object (such as metallic object 302) falling from, for example, the rig floor into the interior of the catcher assembly, to be attracted towards and become magnetically attached to the inner surface of the catcher assembly (such as inwardly sloping inner surface 206 or 208). In the embodiment shown in FIG. 1, magnets 252 are within the sloping walls 216 and 218 of catcher assembly 156; in addition or alternatively, some embodiments, walls 216 and 218 are themselves magnetized, such that the walls themselves are the magnets. In some embodiments, for example as shown in FIG. 5, in addition to (or instead of) magnets being included within or forming magnetized walls, external magnets such as magnets 502 can be positioned on an exterior surface of the catcher assembly and configured to direct a magnetic field through the walls (for example, walls 216 and/or 218) of catcher 156.

In the illustrated embodiment, the nested frustal segments 202 and 204 and their respective sloping inner surfaces 206 and 208 are separated or bounded by horizontal annular discs 224, 226, and 228. In some embodiments, the horizontal annular discs can include magnets 252 within them or be comprised of a magnetic material. The upper surfaces of annular discs 224, 226, and 228 provide horizontal surfaces or "shelves" which provide surface on which falling metal objects can land, be deflected, ricochet, or bounce, thus slowing or interrupting the fall of the objects within the interior of catcher assembly 156. By stopping, interrupting, deflecting, or slowing the vertical fall of the objects, the horizontal surfaces of annular discs 224, 226, and 228 and the sloped angle of inner surfaces 206 and 208 increase the effectiveness of the magnets in attracting and capturing the objects to catcher assembly 156. Therefore, catcher assembly 156 can catch larger, heavier, or a greater number of metal objects as compared to if the magnets were within (or on) a vertical surface (such as the cylindrical portions of the bell nipple or within into central bore 154 of main body 152 or bore 132 of BOP stack 130). Furthermore, because the frustal segments are inverted frusta that are open at the top, objects that have landed on or been attracted to sloping surfaces 206 and 208 or the upper surfaces of annular discs 224, 226, and 228 can be more easily or more readily retrieved (for example, by extending a retrieval tool from the rig floor), than objects that have fallen into central bore 154 of main body 152 or bore 132 of BOP stack 130. In some embodiments, catcher assembly 156 is removable or detachable from tubular main body 152, further enabling easy retrieval of objects captured by catcher assembly 156.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A bell nipple assembly, comprising:

a tubular main body defining a central passage with a first diameter and having a central axis; and a catcher assembly comprising:

a bell nipple having a conical body including an inner surface inwardly sloping relative to the central axis and having a downhole end fluidically connected to the tubular main body, the inner surface defining an uphole passage with a second diameter and a downhole passage with a third diameter smaller than the second diameter, the first diameter smaller than the third diameter; and one or more magnets attached to the inner surface of the inwardly-sloping inner surface of the bell nipple.

2. The bell nipple assembly of claim 1, wherein at least a portion of the one or more magnets is within or comprises the inwardly-sloping inner surface.

3. The bell nipple assembly of claim 1, wherein at least a portion of the one or more magnets comprises one or more magnets positioned on an exterior surface of the catcher assembly and configured to direct a magnetic field through a wall of the catcher assembly.

4. The bell nipple assembly of claim 1, wherein the inwardly-sloping inner surface is frustoconical.

5. The bell nipple assembly of claim 1, wherein the bell nipple comprises a plurality of nested frustal segments, each of the plurality of nested frustal segments forming at least a portion of the inwardly-sloping inner surface.

6. The bell nipple assembly of claim 5, wherein the inwardly-sloping inner surface is bounded by horizontal annular discs.

7. The bell nipple assembly of claim 1, wherein the inwardly-sloping inner surface is frustospherical.

8. The bell nipple assembly of claim 1, wherein the inwardly-sloping inner surface is frustoparabolic.

9. The bell nipple assembly of claim 1, wherein the bell nipple assembly is configured to be positioned above a blow-out preventer stack and below a rig floor of a well drilling system, where the rig floor comprises a rotary table, and the diameter of an upper opening of the catcher assembly is greater than a diameter of the rotary table.

10. The bell nipple assembly of claim 9, wherein the blow-out preventer stack comprises a plurality of preventers.

11. The bell nipple assembly of claim 1, further comprising a flowline configured to flow fluid from the tubular main body.

12. The bell nipple assembly of claim 1, wherein the catcher assembly is removable from the tubular main body.

13. A drilling system for drilling a wellbore into a subterranean zone, comprising:

a drill string suspended from a drilling rig;

a blow-out preventer stack through which the drill string passes as the drill string is raised or lowered within the wellbore; and a bell nipple assembly configured to be positioned above the blow-out preventer stack and below a rig floor of the drilling rig, the bell nipple assembly comprising:

a tubular main body defining a central passage with a first diameter and having a central axis;

a catcher assembly comprising:

a bell nipple having a conical body including an inner surface inwardly sloping relative to the central axis and having a downhole end fluidically connected to the tubular main body, wherein the inner surface defining an uphole passage with a second diameter and a downhole passage with a third diameter smaller than the second diameter, the first diameter is smaller than the third diameter; and one or more magnets attached to the inner surface of the inwardly-sloping inner surface of the bell nipple.

14. The drilling system of claim 13, wherein at least a portion of the one or more magnets is within or comprises the inwardly-sloping inner surface of the bell nipple.

15. The drilling system of claim 13, wherein at least a portion of the one or more magnets comprises one or more magnets positioned on an exterior surface of the catcher assembly and configured to direct a magnetic field through a wall of the catcher assembly.

16. The drilling system of claim 13, wherein the inwardly-sloping inner surface is frustoconical.

17. The drilling system of claim 13, wherein the catcher assembly comprises a plurality of nested frustal segments, each of the plurality of nested frustal segments forming a portion of the inwardly-sloping inner surface.

18. The drilling system of claim 17, wherein the inwardly-sloping inner surface is bounded by horizontal annular discs.

19. The drilling system of claim 13, wherein the inwardly-sloping inner surface is frustospherical.

20. The drilling system of claim 13, wherein the inwardly-sloping inner surface is frustoparabolic.

21. The drilling system of claim 13, wherein the rig floor comprises a rotary table and wherein a diameter of an upper opening of the catcher assembly is greater than a diameter of the rotary table.

22. The drilling system of claim 13, wherein the blow-out preventer stack comprises a plurality of preventers.

23. The drilling system of claim 13, wherein the catcher assembly is removable from the tubular main body.

24. A method of drilling, with a drill string suspended from a drilling rig, a wellbore into a subterranean zone, the method comprising:

passing the drill string through a blow-out preventer of the drilling rig as the drill string is raised or lowered within the wellbore;

attaching, to an upper end of the blow-out preventer stack, a bell nipple assembly, the bell nipple assembly positioned below a rig floor of the drilling rig and comprising:

a tubular main body defining a central passage with a first diameter and having a central axis; and a catcher assembly comprising:

one or more magnets attached to an inner surface of one or more inwardly-sloping inner surfaces of the bell nipple assembly;

drilling the wellbore with the drill string;

catching, during the drilling and by the catcher assembly, fluids falling from the rig floor or from an exterior surface of the drill string;

directing, by the catcher assembly, the fluids to the tubular main body; and attracting, by the one or more magnets, a magnetic object falling within the interior of the catcher assembly towards the one or more inwardly-sloping inner surfaces.

* * * * *